US011300928B2

(12) United States Patent
Lin

(10) Patent No.: US 11,300,928 B2
(45) Date of Patent: Apr. 12, 2022

(54) TIMEPIECE MOVEMENT

(71) Applicant: DONGGUAN YOUNG TOWN ELECTRONICS CO., LTD., Dongguan (CN)

(72) Inventor: Chin-Hsuen Lin, Taipei (TW)

(73) Assignee: DONGGUAN YOUNG TOWN ELECTRONICS CO., LTD., Dongguan (CN)

( * ) Notice: Subject to any disclaimer, the term of this patent is extended or adjusted under 35 U.S.C. 154(b) by 511 days.

(21) Appl. No.: 16/443,521

(22) Filed: Jun. 17, 2019

(65) Prior Publication Data

US 2020/0393795 A1 Dec. 17, 2020

(51) Int. Cl.
*G04B 19/25* (2006.01)
*G04B 19/253* (2006.01)

(52) U.S. Cl.
CPC ..... *G04B 19/25* (2013.01); *G04B 19/253* (2013.01)

(58) Field of Classification Search
CPC ..... G04B 19/24; G04B 19/25; G04B 19/253
See application file for complete search history.

(56) References Cited

U.S. PATENT DOCUMENTS 2,741,082 A * 4/1956 Elberg ..... G04B 19/25366 368/37
8,526,272 B2 * 9/2013 Kallestad ..... G04F 8/00 368/80
8,811,125 B2 * 8/2014 Schmidt ..... G04B 19/2536 368/37
2005/0254349 A1 * 11/2005 Kallestad ..... G04F 8/00 368/28

* cited by examiner

*Primary Examiner* — Amy Cohen Johnson
*Assistant Examiner* — Jason M Collins
(74) *Attorney, Agent, or Firm* — Lando & Anastasi, LLP

(57) ABSTRACT

A timepiece movement includes a movement case, a drive mechanism, a time mechanism driven by the drive mechanism, a day mechanism, and a day adjustment mechanism. The day mechanism is driven by the time mechanism through a frictional engagement therebetween. Once a torque generated by the day adjustment mechanism overcomes the frictional engagement, the day mechanism is permitted to be driven by the day adjustment mechanism. Therefore, an indicated day of the timepiece movement can be adjusted without pulling out of a day adjustment knob or an actuating shaft of the day adjustment mechanism.

15 Claims, 5 Drawing Sheets

TIMEPIECE MOVEMENT

FIELD

The disclosure relates to a timepiece movement, more particularly to a timepiece movement with a day adjustment mechanism.

BACKGROUND

U.S. Pat. No. 8,526,272 B2 discloses a conventional day clock which has day, hour, and minute hands revolving continuously around a common center. The conventional day clock has a time adjustment knob and a day adjustment knob. When the day adjustment knob is pulled out, a set of gears are disengaged, allowing the day hand to be adjusted with that knob without affecting the other hands. Then, when the set of gears are reengaged, the time adjustment knob can be utilized to set the time of day. In order to set the day and time accurately, the user may first set the time to midnight with the time adjustment knob, pull out the day adjustment knob, set the day to a clock face line between days with that knob, push that knob back in, and then set the time to the correct time with the time adjustment knob.

SUMMARY

An object of the disclosure is to provide a novel timepiece movement. With the provision of the timepiece movement in a timepiece, an indicated day of the timepiece can be adjusted without pulling out of a day adjustment knob or an actuating shaft of a day adjustment mechanism.

According to the disclosure, a timepiece movement includes a movement case, a drive mechanism, a time mechanism, a day mechanism, and a day adjustment mechanism. The drive mechanism is mounted inside the movement case. The time mechanism is mounted to the movement case, and is configured to be driven by and engaged with the drive mechanism. The time mechanism includes an hour mechanism which includes a tubular hour shaft and an hour gear. The tubular hour shaft extends along a central axis in a front-to-rear direction to terminate at a front end segment and a rear end segment. The hour gear is mounted on the rear end segment of the tubular hour shaft, and is coupled to be driven by the drive mechanism so as to permit the tubular hour shaft to turn with the hour gear about the central axis. The day mechanism is mounted to the movement case, and includes a transmission gear, a day gear, and a day gear set. The transmission gear is sleeved on the rear end segment of the tubular hour shaft to be displaced from the hour gear, and includes an outer ring segment and an inner ring segment. The transmission gear is convertible between a co-rotation state, where the transmission gear co-rotates with the tubular hour shaft through a frictional engagement between the inner ring segment and the tubular hour shaft, and a relative rotation state, where the transmission gear rotates relative to the tubular hour shaft. The day gear is mounted inside the movement case to be rotatable relative to the tubular hour shaft about the central axis. The day gear set is disposed to couple the outer ring segment with the day gear so as to permit the day gear to be driven by the transmission gear to turn about the central axis. The day adjustment mechanism is mounted to the movement case, and includes a first actuating shaft which extends to terminate at a first operating end and a first coupling end. The first coupling end is configured to transmit a first force exerted on the first operating end to the transmission gear through the day gear set such that when the exerted first force is sufficient to generate a torque overcoming the frictional engagement between the inner ring segment and the tubular hour shaft to thereby convert the transmission gear to the relative rotation state, the day gear is driven by the day gear set to turn about the central axis.

BRIEF DESCRIPTION OF THE DRAWINGS

Other features and advantages of the disclosure will become apparent in the following detailed description of the embodiment(s) with reference to the accompanying drawings, in which.

DETAILED DESCRIPTION

To aid in describing the disclosure, directional terms may be used in the specification and claims to describe portions of the present disclosure (e.g., front, rear, left, right, top, bottom, etc.). These directional definitions are intended to merely assist in describing and claiming the disclosure and are not intended to limit the disclosure in any way.

Figure 1:
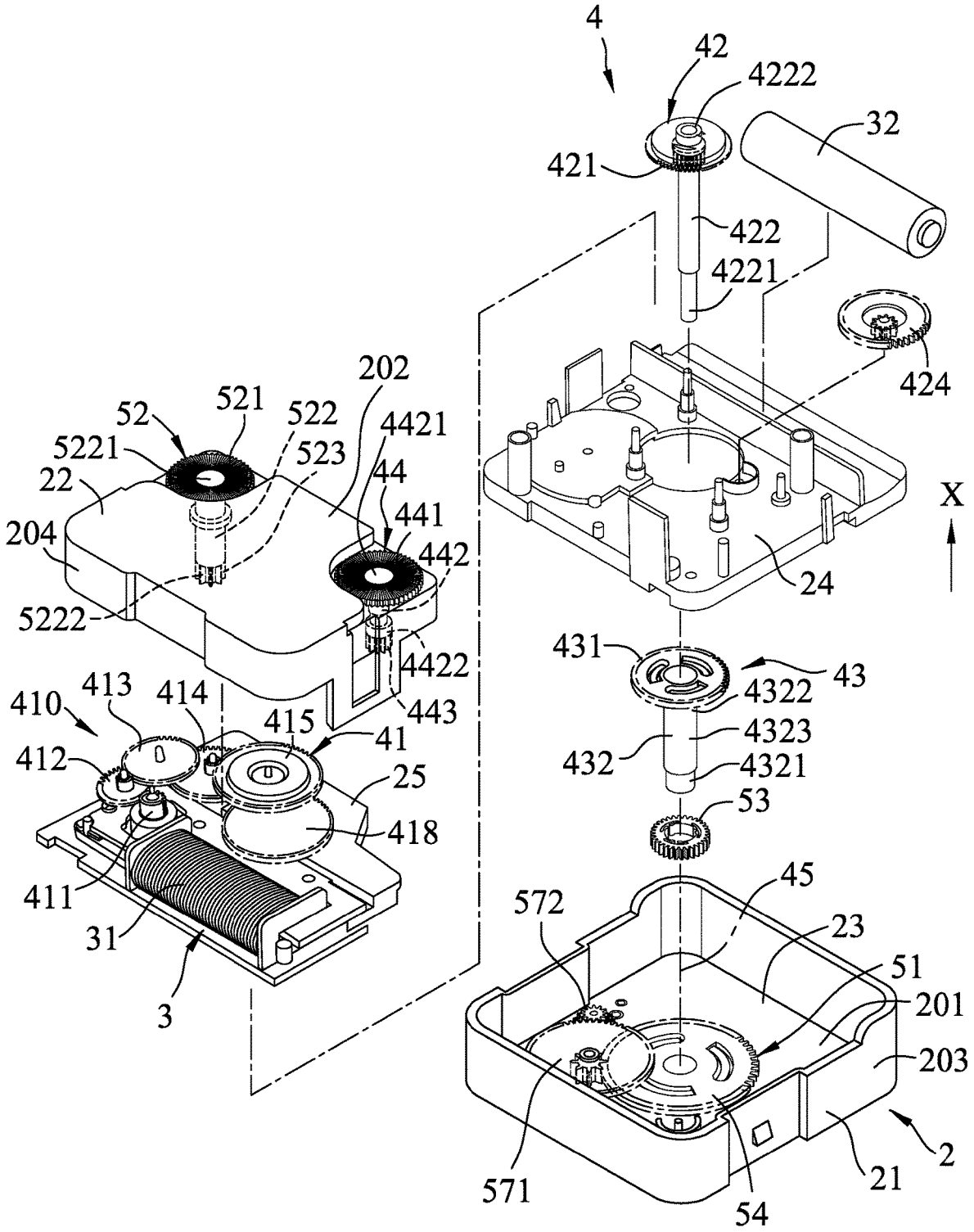
FIG. 1 is an exploded perspective view of a timepiece movement according to an embodiment of the disclosure.

Referring to FIG. 1, a timepiece movement according to an embodiment of the disclosure is shown to include a movement case 2, a drive mechanism 3, a time mechanism 4, a day mechanism 51, and a day adjustment mechanism 52.

In an embodiment shown in FIG. 1, the movement case 2 has a front case part 21, a rear case part 22, a front partition wall 24, and a rear partition wall 25. The front and rear case parts 21, 22 are adapted to be mounted proximate to and distal from a clock face of a timepiece (not shown), respectively.

The front case part 21 has a front wall 201 and a front surrounding wall 203 extending rearwardly from a periphery of the front wall 201.

The rear case part 22 has a rear wall 202 which is opposite to the front wall 201 in a front-to-rear direction (X), and a rear surrounding wall 204 which extends forwardly from a periphery of the rear wall 202, and which is configured to be detachably mounted to the front surrounding wall 203 such that the front and rear case parts 21, 22 define therebetween an accommodation space 23.

The front and rear partition walls 24, 25 are disposed in the accommodation space 23 in proximity to the front and rear walls 201, 202, respectively.

The drive mechanism 3 is mounted inside the movement case 2. In an embodiment shown in FIG. 1, the drive mechanism 3 is mounted in the accommodation space 23, and includes a transmission motor 31 which is supported by the rear partition wall 25, and a battery 32 which is electrically connected to the transmission motor 31 for supplying electricity to the transmission motor 31, and which is detachably supported by the front partition wall 24. The transmission motor 31 may be, but is not limited to, a stepping motor.

The time mechanism 4 is mounted to the movement case 2, and is configured to be driven by and engaged with the drive mechanism 3. The time mechanism 4 includes an hour mechanism 43 which includes a tubular hour shaft 432 and an hour gear 431. In an embodiment shown in FIG. 1, the hour mechanism 43 is supported by the front wall 201.

The tubular hour shaft 432 extends along a central axis 45 in the front-to-rear direction (X) to terminate at a front end segment 4321 and a rear end segment 4322. The tubular hour shaft 432 has a middle segment 4323 between the front and rear end segments 4321, 4322. In an embodiment shown in FIGS. 1 and 3, the front and rear end segments 4321, 4322 are disposed forwardly and rearwardly of the front wall 201, respectively.

The hour gear 431 is mounted on the rear end segment of the tubular hour shaft 432, and is coupled to be driven by the drive mechanism 3 so as to permit the tubular hour shaft 432 to turn with the hour gear 431 about the central axis 45.

Figure 3:
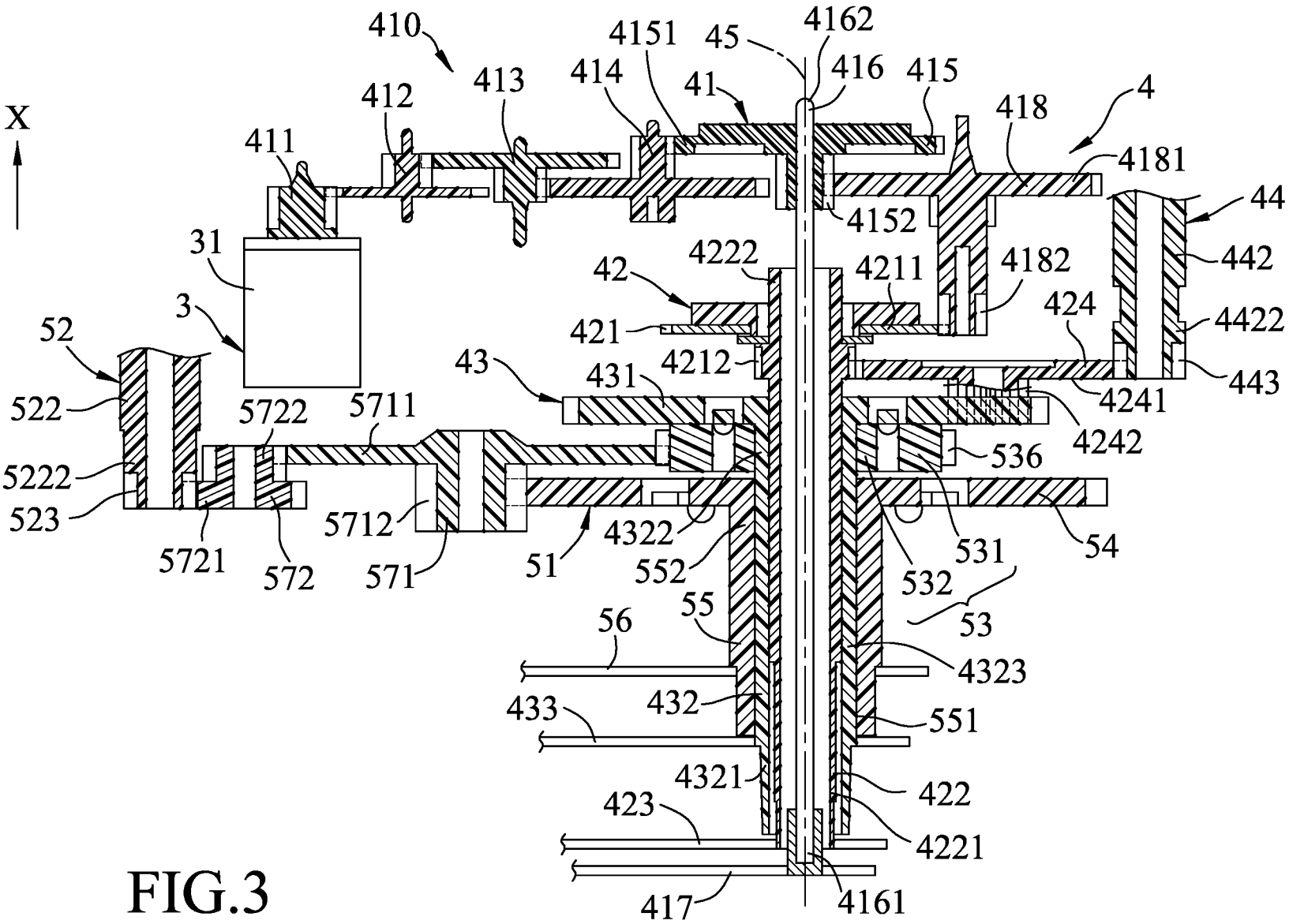
FIG. 3 is a fragmentary and partially cross-sectional view of the timepiece movement.

In an embodiment shown in FIG. 3, the hour mechanism 43 further includes an hour hand 433 which is mounted on the front end segment 4321 to turn with the tubular hour shaft 432 so as to permit the hour hand 433 to indicate an hour of a day.

The day mechanism 51 is mounted to the movement case 2, and includes a transmission gear 53, a day gear 54, and a day gear set 571. In an embodiment shown in FIG. 1, the day mechanism 1 is supported by the front wall 201.

The transmission gear 53 is sleeved on the rear end segment 4322 of the tubular hour shaft 432 to be displaced from the hour gear 431, and includes an outer ring segment 531 and an inner ring segment 532. The transmission gear 53 is convertible between a co-rotation state and a relative rotation state. In the co-rotation state, the transmission gear 53 co-rotates with the tubular hour shaft 432 through a frictional engagement between the inner ring segment 532 and the tubular hour shaft 432 (see FIG. 5). In the relative rotation state, the transmission gear 53 rotates relative to the tubular hour shaft 432.

In an embodiment shown in FIGS. 2 to 5, the outer ring segment 531 has a rim 530 formed with a plurality of transmission teeth 536. The inner ring segment 532 is formed with a plurality of resilient contact members 533 which are angularly displaced from each other about the central axis 45, and which are configured to be brought into frictional engagement with the tubular hour shaft 432 when the transmission gear 53 is in the co-rotation state.

Figure 5:
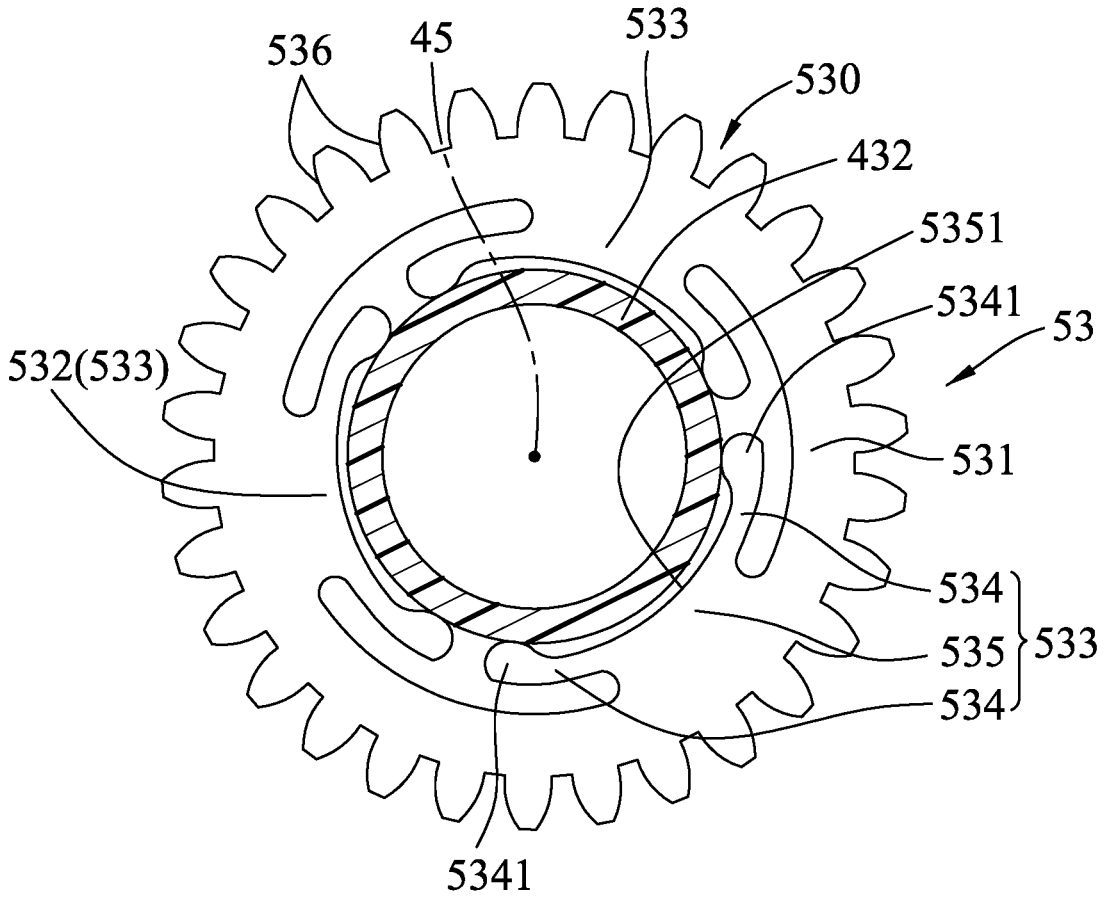
FIG. 5 is a partially cross-sectional view illustrating a transmission gear and a tubular hour shaft of the timepiece movement.

In an embodiment shown in FIG. 5, each of the resilient contact members 533 includes a connection neck 535 and two suspending arms 534. The connection neck 535 extends radially and inwardly from the outer ring segment 531 to terminate at a connection end 5351. The two suspending arms 534 extend oppositely from the connection end 5351 in a circumferential direction about the central axis 45 to respectively terminate at enlarged contact ends 5341 which are configured to be brought into frictional engagement with the tubular hour shaft 432 when the transmission gear 53 is in the co-rotation state.

The day gear 54 is mounted inside the movement case 2 to be rotatable relative to the tubular hour shaft 432 about the central axis 45.

The day gear set 571 is disposed to couple the outer ring segment 531 with the day gear 54 so as to permit the day gear 54 to be driven by the transmission gear 53 to turn about the central axis 45.

Figure 2:
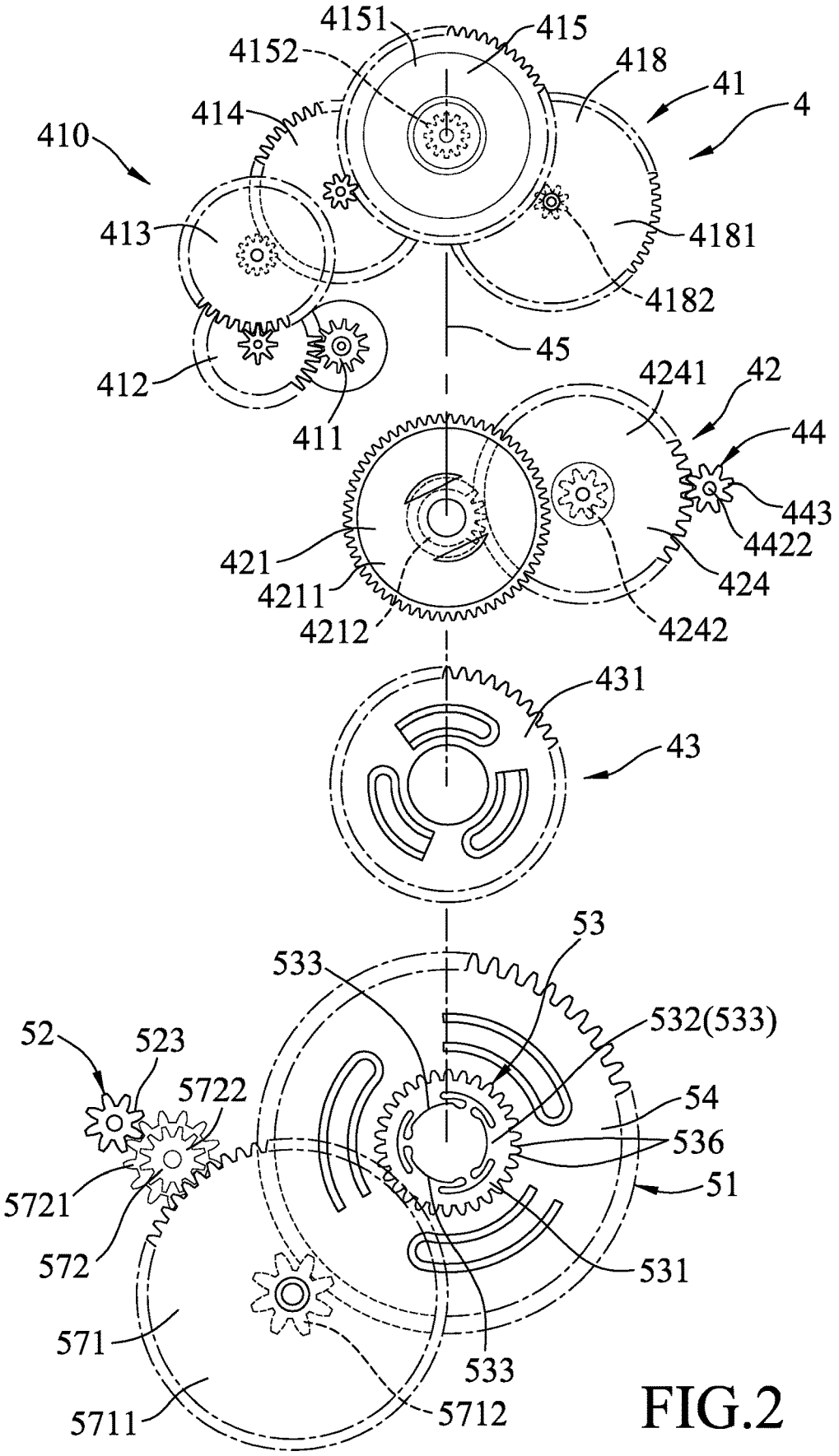
FIG. 2 is a schematic plane view illustrating mechanisms in different planes of the timepiece movement.
Figure 4:
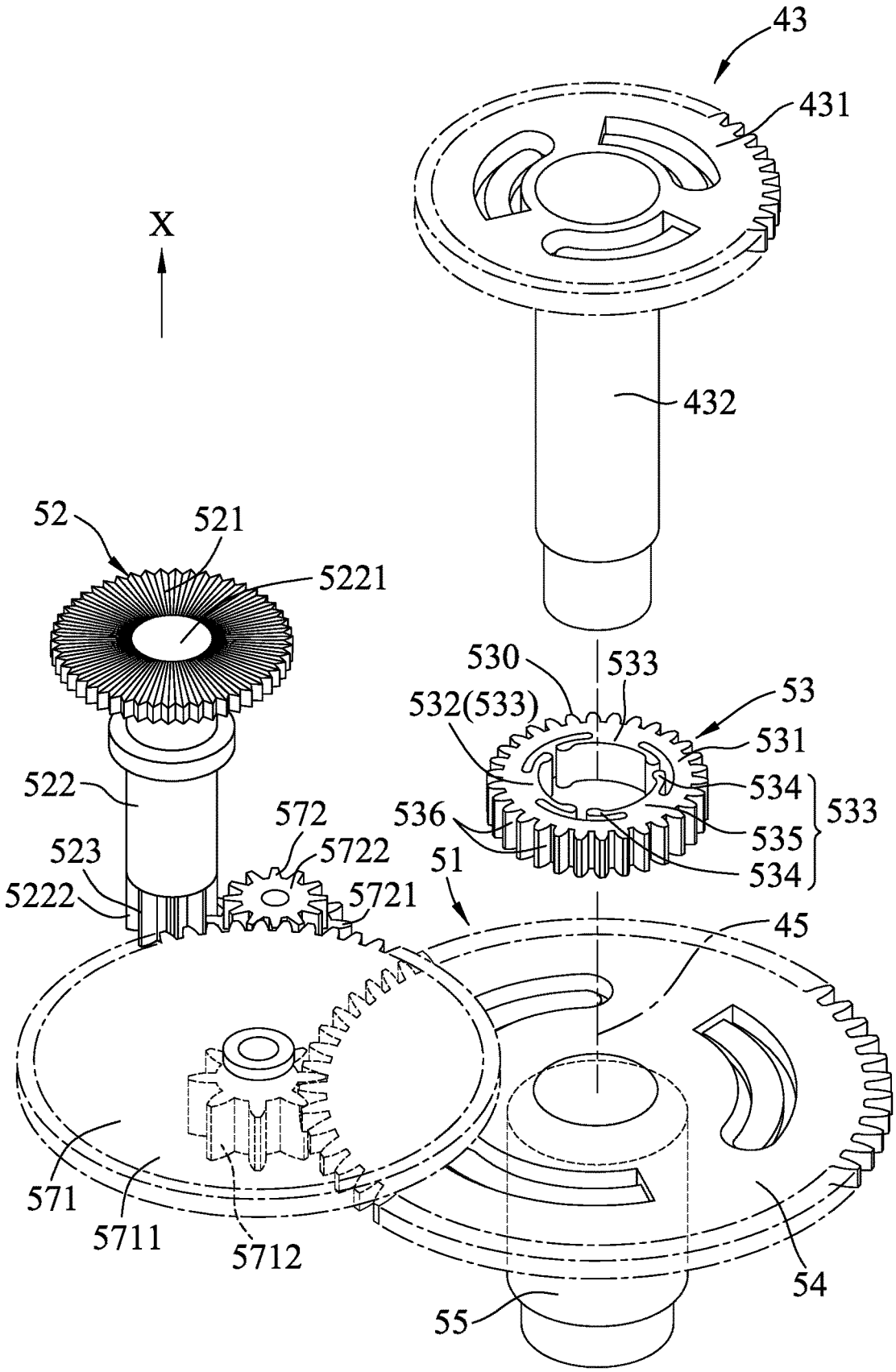
FIG. 4 is an enlarged exploded perspective view illustrating a day adjustment mechanism of the timepiece movement and related elements thereof.

In an embodiment shown in FIGS. 2 to 4, the day gear set 571 includes a first wheel 5711 which is configured to mesh with the transmission teeth 536, and a first pinion 5712 which co-axially rotates with the first wheel 5711, and which is configured to mesh with the day gear 54 so as to permit the day gear 54 to be driven by the transmission gear 53 through the day gear set 571.

In an embodiment shown in FIG. 3, the day mechanism 51 further includes a tubular day shaft 55 and a day hand 56.

The tubular day shaft 55 is sleeved on the middle segment 4323 of the tubular hour shaft 432, and has a front end segment 551 and a rear end segment 552, which are disposed forwardly and rearwardly of the front wall 201, respectively. The day gear 54 is mounted on the rear end segment 552 so as to permit the tubular day shaft 55 to turn with the day gear 54 about the central axis 45.

The day hand 56 is mounted on the front end segment 551 to turn with the tubular day shaft 55 such that when the transmission gear 53 is in the co-rotation state, the day hand 56 is permitted to be driven by the transmission gear 53 through the day gear set 571 to indicate the day of a week.

The day adjustment mechanism 52 is mounted to the movement case 2, and includes a first actuating shaft 522 extending to terminate at a first operating end 5221 and a first coupling end 5222 which are disposed rearwardly and forwardly of the rear wall 202, respectively. The first coupling end 5222 is configured to transmit a first force exerted on the first operating end 5221 to the transmission gear 53 through the day gear set 571 such that when the exerted first force is sufficient to generate a torque overcoming the frictional engagement between the inner ring segment 532 and the tubular hour shaft 432 to thereby convert the transmission gear 53 to the relative rotation state, the day gear 54 is driven by the day gear set 571 to turn about the central axis 45. In addition, when the transmission gear 53 is converted to the relative rotation state, the day hand 56 is driven by the first actuating shaft 52 through the day gear set 571 to indicate a selected one day of the week. Therefore, when adjusting the day of the week, it is only necessary to turn the first actuating shaft 522, without pulling out the first actuating shaft 522.

In an embodiment shown in FIGS. 2 to 4, the first coupling end 5222 is formed with a plurality of first coupling teeth 523 which are angularly displaced from each other.

In an embodiment shown in FIGS. 1 to 4, the day adjustment mechanism 52 further includes an adjustment compound gear 572. The adjustment compound gear 572 is supported by the front wall 201, and includes a second wheel 5721 which is configured to mesh with the first coupling teeth 523, and a second pinion 5722 which co-axially rotates with the second wheel 5721, and which is configured to mesh with the first wheel 5711 at a position angularly displaced from the transmission gear 53 so as to permit the exerted first force to be transmitted to the transmission gear 53 through the day gear set 571 and the adjustment compound gear 572.

In an embodiment shown in FIGS. 1 and 4, the day adjustment mechanism 52 further includes a day adjustment knob 521 which is coupled to the first operating end 5221 to permit the first actuating shaft 522 to turn with the day adjustment knob 521.

In an embodiment shown in FIGS. 2 and 3, the time mechanism 4 further includes a minute mechanism 42 which is supported by the front partition wall 24, and which includes a tubular minute shaft 422, a minute hand 423, a minute gear unit 421, and a minute gear set 424.

The tubular minute shaft 422 extends along the central axis 45 through the tubular hour shaft 432 to terminate at a front end segment 4221 and a rear end segment 4222, which are disposed forwardly and rearwardly of the front wall 201, respectively.

The minute hand 423 is mounted on the front end segment 4221 to turn with the tubular minute shaft 422 so as to permit the minute hand 423 to indicate a minute of the hour.

The minute gear unit 421 is mounted on the rear end segment 4222 to permit the tubular minute shaft 422 to turn therewith, and includes a third wheel 4211 which is coupled to be driven by the drive mechanism 3 to turn about the central axis 45, and a third pinion 4212 which co-axially rotates with the third wheel 4211.

The minute gear set 424 includes a fourth wheel 4241 which is configured to mesh with the third pinion 4212, and a fourth pinion 4242 which co-axially rotates with the fourth wheel 4241, and which is configured to mesh with the hour gear 431 so as to permit the hour gear 431 to be driven by the drive mechanism 3 through the minute gear unit 421 and the minute gear set 424.

In an embodiment shown in FIGS. 1 to 3, the time mechanism 4 further includes a second mechanism 41 which is supported by the rear partition wall 25, and which includes an elongated second pin 416, a second hand 417, a second gear unit 415, and a second gear set 418.

The elongated second pin 416 extends along the central axis 45 through the tubular minute shaft 422 to terminate at a front end segment 4161 and a rear end segment 4162, which are disposed forwardly and rearwardly of the front wall 201, respectively.

The second hand 417 is mounted on the front end segment 4161 to turn with the elongated second pin 416 so as to permit the second hand 417 to indicate a second of the minute.

The second gear unit 415 is mounted on the rear end segment 4162 to permit the elongated second pin 416 to turn therewith, and includes a fifth wheel 4151 which is coupled to be driven by the drive mechanism 3 to turn about the central axis 45, and a fifth pinion 4152 which co-axially rotates with the fifth wheel 4151.

The second gear set 418 includes a sixth wheel 4181 which is configured to mesh with the fifth pinion 4152, and a sixth pinion 4182 which co-axially rotates with the sixth wheel 4181. The sixth pinion 4182 is configured to mesh with the third wheel 4211 so as to permit the minute gear unit 421 to be driven by the drive mechanism 3 through the second gear unit 415 and the second gear set 418.

In an embodiment shown in FIGS. 1 to 3, the second mechanism 41 further includes a driving gear train 410. The driving gear train 410 includes an input gear 411 which is coupled to driven by the transmission motor 31 of the drive mechanism 3, and an output gear assembly 414 which is configured to mesh with the fifth wheel 4151 so as to permit the second gear unit 415 to be driven by the transmission motor 31 through the drive driving gear train 410. The driving gear train 410 may further include two compound gears 412, 413 which are coupled between the input gear 411 and the output gear assembly 414.

In an embodiment shown in FIGS. 1 to 3, the timepiece movement further includes a time adjustment mechanism 44 which includes a second actuating shaft 442 extending to terminate at a second operating end 4421 and a second coupling end 4422 that are disposed rearwardly and forwardly of the rear wall 202, respectively. The second coupling end 4422 is formed with a plurality of second coupling teeth 443 which are configured to mesh with the fourth wheel 4241 at a position angularly displaced from the third pinion 4212, so as to transmit a second force exerted on the second operating end 4421 to both the tubular hour shaft 432 and the tubular minute shaft 422, to thereby adjust the hour indicated by the hour hand 433 and adjust the minute indicated by the minute hand 423.

In an embodiment shown in FIG. 1, the time adjustment mechanism 44 further includes a time adjustment knob 441 which is coupled to the second operating end 4421 to permit the second actuating shaft 442 to turn with the time adjustment knob 441.

In sum, when adjusting the day of the week, it is only necessary to turn the day adjustment knob 521 together with the first actuating shaft 522, without pulling out of the first actuating shaft 522 or the day adjustment knob 521.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A timepiece movement comprising:

a movement case;

a drive mechanism mounted inside said movement case;

a time mechanism mounted to said movement case, and configured to be driven by and engaged with said drive mechanism, said time mechanism including an hour mechanism which includes a tubular hour shaft which extends along a central axis in a front-to-rear direction to terminate at a front end segment and a rear end segment, and an hour gear mounted on said rear end segment of said tubular hour shaft, and coupled to be driven by said drive mechanism so as to permit said tubular hour shaft to turn with said hour gear about the central axis;

a day mechanism mounted to said movement case, and including a transmission gear which is sleeved on said rear end segment of said tubular hour shaft to be displaced from said hour gear, and which includes an outer ring segment and an inner ring segment, said transmission gear being convertible between a co-rotation state, where said transmission gear co-rotates with said tubular hour shaft through a frictional engagement between said inner ring segment and said tubular hour shaft, and a relative rotation state, where said transmission gear rotates relative to said tubular hour shaft, a day gear which is mounted inside said movement case to be rotatable relative to said tubular hour shaft about the central axis, and a day gear set disposed to couple said outer ring segment with said day gear so as to permit said day gear to be driven by said transmission gear to turn about the central axis; and a day adjustment mechanism mounted to said movement case, and including a first actuating shaft which extends to terminate at a first operating end and a first coupling end, said first coupling end being configured to transmit a first force exerted on said first operating end to said transmission gear through said day gear set such that when the exerted first force is sufficient to generate a torque overcoming the frictional engagement between said inner ring segment and said tubular hour shaft to thereby convert said transmission gear to the relative rotation state, said day gear is driven by said day gear set to turn about the central axis.

2. The timepiece movement according to claim 1, wherein said inner ring segment is formed with a plurality of resilient contact members which are angularly displaced from each other, and which are configured to be brought into frictional engagement with said tubular hour shaft when said transmission gear is in the co-rotation state.

3. The timepiece movement according to claim 2, wherein each of said resilient contact members includes a connection neck extending radially and inwardly from said outer ring segment to terminate at a connection end, and two suspending arms extending oppositely from said connection end in a circumferential direction about the central axis to respectively terminate at enlarged contact ends which are configured to be brought into frictional engagement with said tubular hour shaft when said transmission gear is in the co-rotation state.

4. The timepiece movement according to claim 1, wherein said movement case has a front wall and a rear wall opposite to said front wall in the front-to-rear direction;

said front and rear end segments of said tubular hour shaft are disposed forwardly and rearwardly of said front wall, respectively; and said first operating end and said first coupling end of said first actuating shaft are disposed rearwardly and forwardly of said rear wall, respectively.

5. The timepiece movement according to claim 4, wherein said hour mechanism further includes an hour hand which is mounted on said front end segment of said tubular hour shaft to turn with said tubular hour shaft so as to permit said hour hand to indicate an hour of a day;

said tubular hour shaft has a middle segment between said front and rear end segments;

said day mechanism further includes a tubular day shaft sleeved on said middle segment of said tubular hour shaft, and having a front end segment and a rear end segment, which are disposed forwardly and rearwardly of said front wall, respectively, said day gear being mounted on said rear end segment of said tubular day shaft so as to permit said tubular day shaft to turn with said day gear about the central axis, and a day hand mounted on said front end segment of said tubular day shaft to turn with said tubular day shaft such that when said transmission gear is in the co-rotation state, said day hand is permitted to be driven by said transmission gear through said day gear set to indicate the day of a week, and such that when said transmission gear is in the relative rotation state, said day hand is driven by said first actuating shaft through said day gear set to indicate a selected one day of the week.

6. The timepiece movement according to claim 5, wherein said outer ring segment of said transmission gear has a rim formed with a plurality of transmission teeth;

said day gear set includes a first wheel which is configured to mesh with said transmission teeth, and a first pinion which co-axially rotates with said first wheel, and which is configured to mesh with said day gear so as to permit said day gear to be driven by said transmission gear through said day gear set;

said first coupling end of said first actuating shaft is formed with a plurality of first coupling teeth which are angularly displaced from each other; and said day adjustment mechanism further includes an adjustment compound gear including a second wheel which is configured to mesh with said first coupling teeth, and a second pinion which co-axially rotates with said second wheel, and which is configured to mesh with said first wheel at a position angularly displaced from said transmission gear so as to permit the exerted first force to be transmitted to said transmission gear through said day gear set and said adjustment compound gear.

7. The timepiece movement according to claim 6, wherein said day adjustment mechanism further includes a day adjustment knob which is coupled to said first operating end to permit said first actuating shaft to turn with said day adjustment knob.

8. The timepiece movement according to claim 6, wherein said time mechanism further includes a minute mechanism which includes a tubular minute shaft extending along the central axis through said tubular hour shaft to terminate at a front end segment and a rear end segment, which are disposed forwardly and rearwardly of said front wall, respectively, a minute hand mounted on said front end segment of said tubular minute shaft to turn with said tubular minute shaft so as to permit said minute hand to indicate a minute of the hour, a minute gear unit mounted on said rear end segment of said tubular minute shaft to permit said tubular minute shaft to turn therewith, said minute gear unit including a third wheel which is coupled to be driven by said drive mechanism to turn about the central axis, and a third pinion which co-axially rotates with said third wheel, and a minute gear set including a fourth wheel which is configured to mesh with said third pinion, and a fourth pinion which co-axially rotates with said fourth wheel, and which is configured to mesh with said hour gear so as to permit said hour gear to be driven by said drive mechanism through said minute gear unit and said minute gear set.

9. The timepiece movement according to claim 8, wherein said time mechanism further includes a second mechanism which includes an elongated second pin extending along the central axis through said tubular minute shaft to terminate at a front end segment and a rear end segment, which are disposed forwardly and rearwardly of said front wall, respectively, a second hand mounted on said front end segment of said elongated second pin to turn with said elongated second pin so as to permit said second hand to indicate a second of the minute, a second gear unit mounted on said rear end segment of said elongated second pin to permit said elongated second pin to turn therewith, said second gear unit including a fifth wheel which is coupled to be driven by said drive mechanism to turn about the central axis, and a fifth pinion which co-axially rotates with said fifth wheel, and a second gear set including a sixth wheel which is configured to mesh with said fifth pinion, and a sixth pinion which co-axially rotates with said sixth wheel, said sixth pinion being configured to mesh with said third wheel of said minute gear unit so as to permit said minute gear unit to be driven by said drive mechanism through said second gear unit and said second gear set.

10. The timepiece movement according to claim 9, further comprising a time adjustment mechanism which includes a second actuating shaft extending to terminate at a second operating end and a second coupling end that are disposed rearwardly and forwardly of said rear wall, respectively, said second coupling end being formed with a plurality of second coupling teeth which are configured to mesh with said fourth wheel at a position angularly displaced from said third pinion, so as to transmit a second force exerted on said second operating end to both said tubular hour shaft and said tubular minute shaft, to thereby adjust the hour indicated by said hour hand and adjust the minute indicated by said minute hand.

11. The timepiece movement according to claim 10, wherein said time adjustment mechanism further includes a time adjustment knob which is coupled to said second operating end to permit said second actuating shaft to turn with said time adjustment knob.

12. The timepiece movement according to claim 9, wherein said drive mechanism includes a transmission motor, and said second mechanism further includes a driving gear train which includes an input gear coupled to driven by said transmission motor, and an output gear assembly configured to mesh with said fifth wheel so as to permit said second gear unit to be driven by said transmission motor through said driving gear train.

13. The timepiece movement according to claim 12, wherein said drive mechanism further includes a battery which is electrically connected to said transmission motor for supplying electricity to said transmission motor.

14. The timepiece movement according to claim 13, wherein said movement case includes a front case part having said front wall and a front surrounding wall which extends rearwardly from a periphery of said front wall, said front wall being configured to support said hour mechanism, said day mechanism, and said adjustment compound gear thereon, a rear case part having said rear wall and a rear surrounding wall which extends forwardly from a periphery of said rear wall, and which is configured to be detachably mounted to said front surrounding wall such that said front and rear case parts define therebetween an accommodation space, a front partition wall which is disposed in said accommodation space in proximity to said front wall, and which is configured to support said battery and said minute mechanism thereon, and a rear partition wall which is disposed in said accommodation space in proximity to said rear wall, and which is configured to support said transmission motor and said second mechanism thereon.

15. The timepiece movement according to claim 13, wherein said transmission motor is a stepping motor.

* * * * *